US007537116B2

(12) United States Patent
Roesler

(10) Patent No.: US 7,537,116 B2
(45) Date of Patent: May 26, 2009

(54) ZERO-CLEARANCE PACKAGING FOR ELONGATE OBJECTS

(76) Inventor: Peter Roesler, Ifenweg 3, D-88239 Wangen/Allgau (DE)

( * ) Notice: Subject to any disclaimer, the term of this patent is extended or adjusted under 35 U.S.C. 154(b) by 254 days.

(21) Appl. No.: 11/279,124

(22) Filed: Apr. 10, 2006

(65) Prior Publication Data

US 2006/0231444 A1 Oct. 19, 2006

(30) Foreign Application Priority Data

Apr. 19, 2005 (DE) ..... 10 2005 018 199

(51) Int. Cl.
*B65D 85/28* (2006.01)

(52) U.S. Cl. ..... 206/379; 206/446

(58) Field of Classification Search ..... 206/349, 206/379, 446, 206, 338, 168, 173, 177, 207, 206/212, 230; 211/69, 70.6
See application file for complete search history.

(56) References Cited

U.S. PATENT DOCUMENTS 3,508,678 A 4/1970 Graham et al.
3,939,967 A * 2/1976 Tenney et al. ..... 206/3
4,046,279 A * 9/1977 Rosler ..... 220/8
4,909,386 A * 3/1990 Jeffers ..... 206/379
5,680,949 A * 10/1997 Roesler ..... 220/8
5,829,591 A * 11/1998 Lyons ..... 206/373

FOREIGN PATENT DOCUMENTS

| | | |
|---|---|---|
| DE | 255 895 C | 1/1913 |
| DE | 578 769 C | 6/1933 |
| DE | 94 00 576.1 U1 | 4/1994 |
| EP | 0 426 060 A2 | 5/1991 |

* cited by examiner

*Primary Examiner*—J. Gregory Pickett
*Assistant Examiner*—Jenine M Pagan
(74) *Attorney, Agent, or Firm*—Frederick L. Tolhurst, Esq.; Cohen & Grigsby, P.C.

(57) ABSTRACT

A zero-clearance packaging for elongate objects, in particular, elongate objects subject to fracture, comprises a packaging sleeve with internal and external parts with a closure disposed therebetween which makes it possible to push the parts together in telescope fashion and to hold the same in particular closed position, wherein at least one elastic tension structure is disposed in at least one of the parts, which stricture prestresses the parts in a closure direction of the packaging against the object stored in the packaging. The elastic tension structure comprises bellows formed by an axial pail of the wall of the parts.

6 Claims, 5 Drawing Sheets

ZERO-CLEARANCE PACKAGING FOR ELONGATE OBJECTS

CLAIM OF PRIORITY

This invention claims the benefit of German Application No DE 10 2005 018 199 6, filed on Apr. 19, 2005,

FIELD OF THE INVENTION

The invention relates to a zero-clearance packaging for elongate objects, in particular, drill bits or other elongate objects subject to fracture risk.

BACKGROUND OF THE INVENTION

The possibility of constructing a plastic packaging in the form of a packaging sleeve comprising an internal part and an external part is known to the art. Between the internal part and the external part, or a closure is disposed making it possible to push the two parts together in telescopic fashion and to hold the same in a particular closed position. In this context, reference is hereby made to a series of patents by the same applicant.

With plastic packaging (packaging sleeves) of this type, it is desirable to hold the object (e.g. a drill bit) stored therein as far as possible in a zero-clearance position. The drill bit is to be protected from being damaged and in the packaged state (with closed packaging), the drill bit should be fixed in place in a way that it is free from vibration and has zero clearance.

It is known in the art to hold the drill bit by its point and by its shank part in the packaging sleeve in matched elastic holding pads. Elastic holding pads receive the point and the shank of the drill bit, respectively, so that when the packaging sleeve is in the closed state, the drill bit is held therein with zero clearance and without vibrating or rattling in the sleeve. A disadvantage of the known packaging sleeve described above, however, is that a particular elastic holding part has to be disposed in the point and/or shank area, which is associated with increased manufacturing cost. Additionally, the assembly is more difficult because a particular tool has to be used to insert the elastic pad into the interior side of the packaging sleeve and to attach it therein. Moreover, there is the danger that the pad may be lost when the packaging is opened, which would prevent the elongate object from being stored in a faultless position

SUMMARY OF THE INVENTION

The claimed invention therefore relates to the object of providing a packaging sleeve that holds an elongate object with zero clearance when the packing sleeve is in the closed state without requiring additional pieces.

The claimed invention comprises a packaging sleeve with an internal and an external part, with a closure disposed therebetween. At least the interior of either the external or the internal part is equipped with a tension spring or elastic tension structure that urges an interior wall of each of the parts against an end of the object held in the packaging and in the direction of a longitudinal axis. Consequently, an essential feature of the invention is the fact that the walls of either the external part, the internal part, or both, of the packaging sleeve are constructed as a tension spring or an elastic tension stricture that is elastically pulled due to the amount of overlap of the closure of the parts, whereby the length of elastic tension structure is increased, thereby applying a compression or clamping force on the elongate object in the direction of a longitudinal axis. In this manner, the elongate object is held in the packaging sleeve with zero clearance and the disposition of a particular point-side and/or shank-side pad is no longer needed. The parts of the packaging sleeve (namely, the internal part and/or the external part) thus act as a tension spring or an elastic tension structure that compresses the elongate object in the packaging sleeve in such a way that it is held with zero clearance.

Preferably, a self-retaining and/or latching closure is the closure of the packaging sleeve because otherwise, the elastic clamping force acting upon the closure in opening direction and affecting the drill bit would cause the closure to open. In a preferred example, the closure is constructed as a latching bayonet closure, which has the advantage that the closure is simple and cannot be opened easily due to the tensile force of the elastic tension structure of the packaging sleeve. An additional advantage of a bayonet closure lies in the fact that the closure may be constructed such that retention-free or resistance-free torsion between the external and internal parts is possible during closure, because the opposing parts of the bayonet closure are constricted in such a way that acute angles on one part meet with the corresponding insertion bevels on the other part, thereby preventing the closure from being blocked when the closure is operated. The invention is not limited to the disposition of a latching bayonet closure. Other closures can also be used between the internal and external parts, such as for example self-retaining threaded closures or latch closures that provide the latching connection as an axial shifting motion.

In this regard, there is a multitude of possibilities intended to be included in the scope of protection of the present invention, The subject of the present invention ensues not only from the subject of the individual patent claims, but also from the combination of the individual patent claims with one another.

All information and features disclosed in the documentation, including the abstract, in particular, the spatial constriction represented in the drawings, are claimed as essential for the invention insofar as they are novel individually or in combination in comparison to the prior art. The invention is explained in detail below with reference to drawings representing several embodiments. From the drawings and their description, additional features and advantages essential for the invention are derived,

DETAILED DESCRIPTION OF EXAMPLES OF EMBODIMENT OF THE INVENTION

Figure 1:
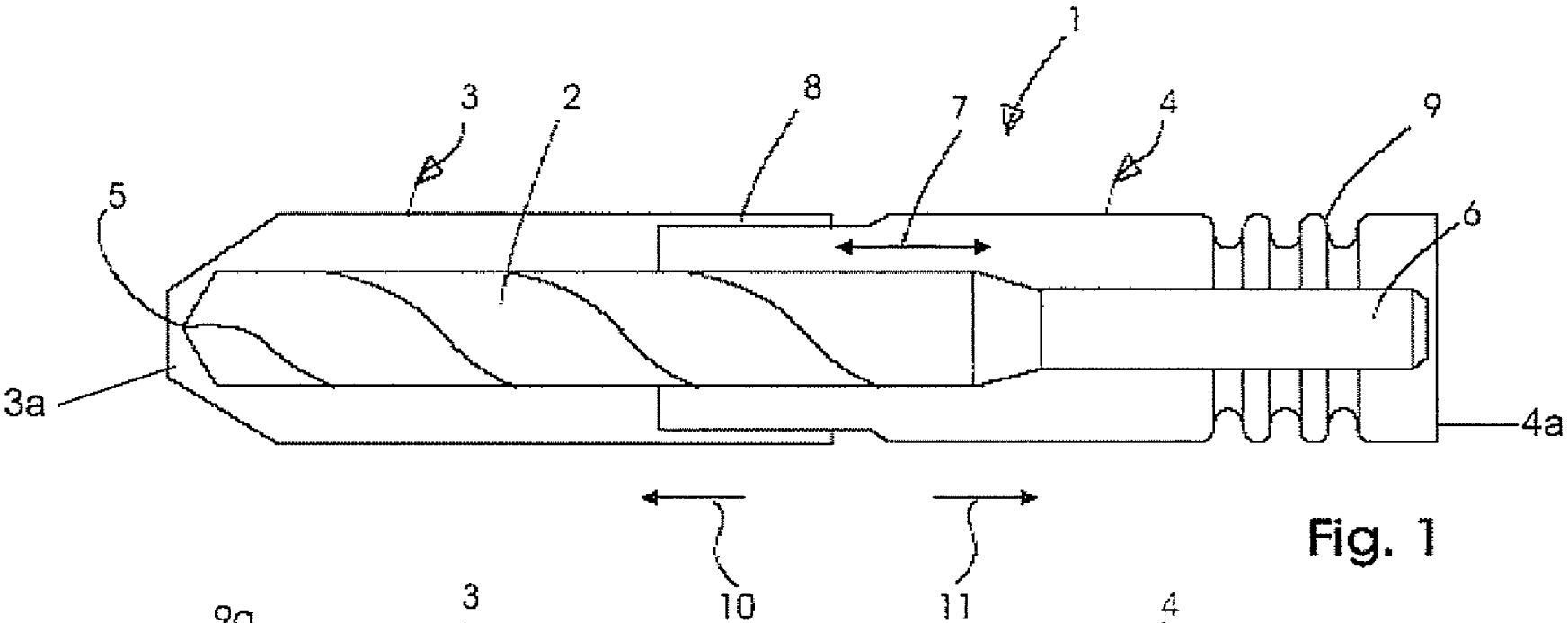
FIG. 1 is a schematic of an example of an embodiment of the claimed packaging sleeve.
Figure 2:
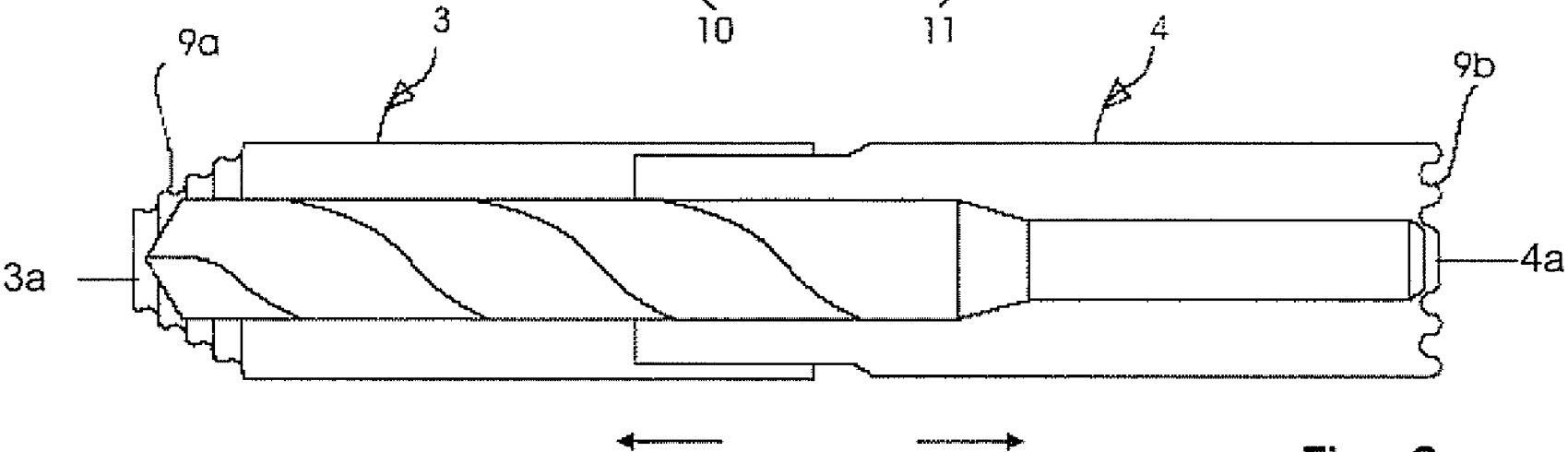
FIG. 2 is a schematic of an example of an embodiment of the claimed packaging sleeve.
Figure 3:
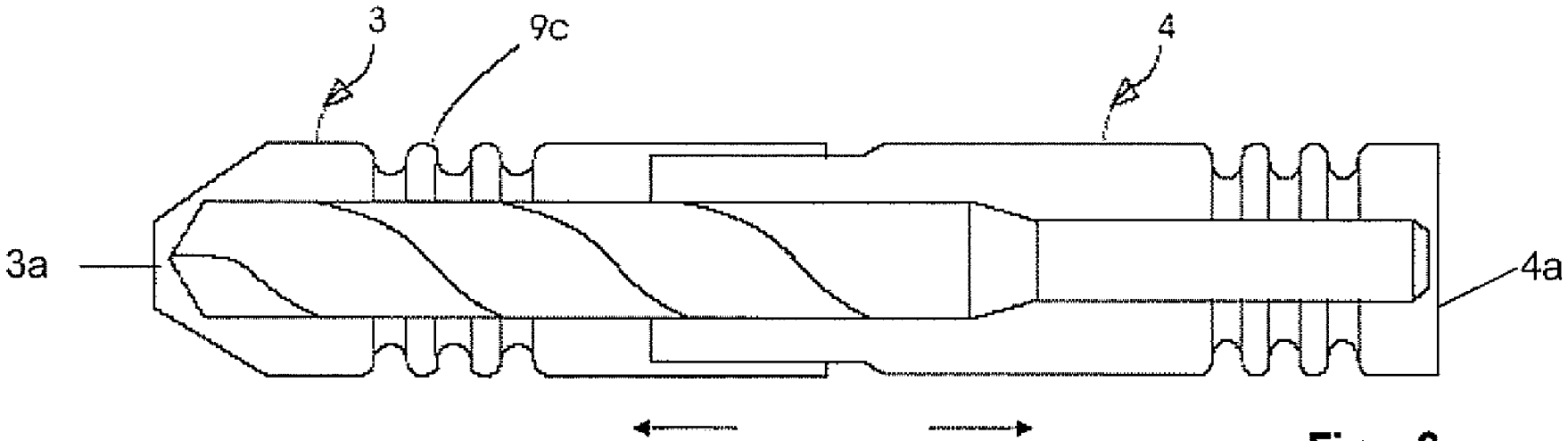
FIG. 3 is a schematic of an example of an embodiment of the claimed packaging sleeve.

The packaging sleeve 1 according to FIGS. 1 through 3 preferably comprises a synthetic material which may be transparent, semi-transparent, or non-transparent. Instead of a synthetic material, any other material can be used, such as carton, a metal material, a synthetic composite material, or other similar material.

The packaging sleeve 1 comprises an external part 3 and an internal part 4 and a self-retaining and/or latching closure 8 between the internal and external parts 3, 4. An elongate object such as a drill bit 2, for example, is to be held with zero clearance in direction of its longitudinal axis (see arrow directions 7) within the interior of the packaging sleeve 1 An interior wall 3*a* of the external part 3 is urged against the point 5 of the drill bit 2 by elastic tension structure 9 (described below) and an interior wall 4*a* of the internal part 4 is urged against the shank 6 of drill bit 2 by elastic tension structure 9. Preferably, no type of protective pad, energy-storing device, spring, elastic tension structure, or other similar device or part is attached to the point 5 and/or the shank 6 as separate parts from the packaging sleeve, and therefore, the point 5 and the shank 6 of the drill bit 2 rest against the interior walls 3*a*, 4*a* of the external and internal parts 3, 4 respectively. In the example shown in FIG. 1, the drill bit is held with zero clearance in the arrow directions 7. As shown in the example, the claimed invention provides a spring or elastic tension structure 9, constructed as bellows, disposed in the area of the jacket surface of the internal part 4. This area of the packaging sleeve is formed in a wave-shape and thus forms a type of bellows which consequently is constructed with longitudinal elasticity in longitudinal direction (arrow directions 7). When closing the packaging sleeve 1, the latter is closed so far that the closure 8 moves into a completely closed state and the drill bit held therein is fixed at the point 5 and the shank 6. Subsequently, the closure is operated by approximately another quarter rotation in order to prestress the elastic tension structure 9 and urge the interior walls 3*a*, 4*a* against ends 5, 6 of the object 2. In this way, the drill bit is fixed in place with zero clearance under the action of an axial stress. Tensile forces are generated and act on the external and internal parts 3, 4 in arrow directions 10, 11 and try to release the closure 8 which consequently has to be equipped with a corresponding closing force. The tensile forces 10, 11 simultaneously firmly hold the drill bit 2 under stress in the packaging sleeve 1 and thus store the drill bit 2 with zero clearance under the action of a stress.

FIG. 2 shows two alternate examples of an elastic tension structure 9. As shown, in an example the elastic tension structure 9*b* can also be constructed as a wave-shaped bottom of the internal part 4 in order to also implement an elastic tension structure integrated directly into the material of the internal part 4. In another example shown in FIG. 2, the tip area of the external part 3 can be constructed with a corresponding elastic tension structure 9*a*, so that the tip area also has wave-shaped deformations in order to act as bellows. The example shown in FIG. 3 shows in kinematic reversal to the embodiment of FIG. 1 that an elastic tension structure 9*c* (constructed as bellows) call also be disposed directly in the area of the external part 3. It is understood that all embodiments of the above described elastic tension structure 9, 9*a*, 9*b*, 9*c* in FIGS. 1 through 3 can also be combined with one another in any desired way. It is also of importance in any case that the resiliency of the elastic tension structure 9-9*c* is so strong that the clearance in the length adjustment of the elastic tension structure 9 in direction of the longitudinal axis of the drill bit 2 is greater than one latch step needed by the latch system of the closure 8 to complete the closed state. An additional advantage of the disposition of an elastic tension structure 9-9*c* in the area of the walls of the packaging sleeve 1 is that the structure acts also as shock absorber when the packaging drops to the floor and impacts on the ground so that the drill bit 2 or other elongate object stored in the packaging sleeve 1 does not rattle or vibrate.

FIGS. 4 through 7 show examples of embodiments of the claimed packaging sleeve. In these examples, the terms of external part 3 and internal part 4 are switched in relation to the representations of FIGS. 1 through 3. This indicates that the terms are random, because it does not matter, how the closure 8 functions, namely, whether the external part 3 reaches across the internal part 4 or vice versa.

Figure 4:
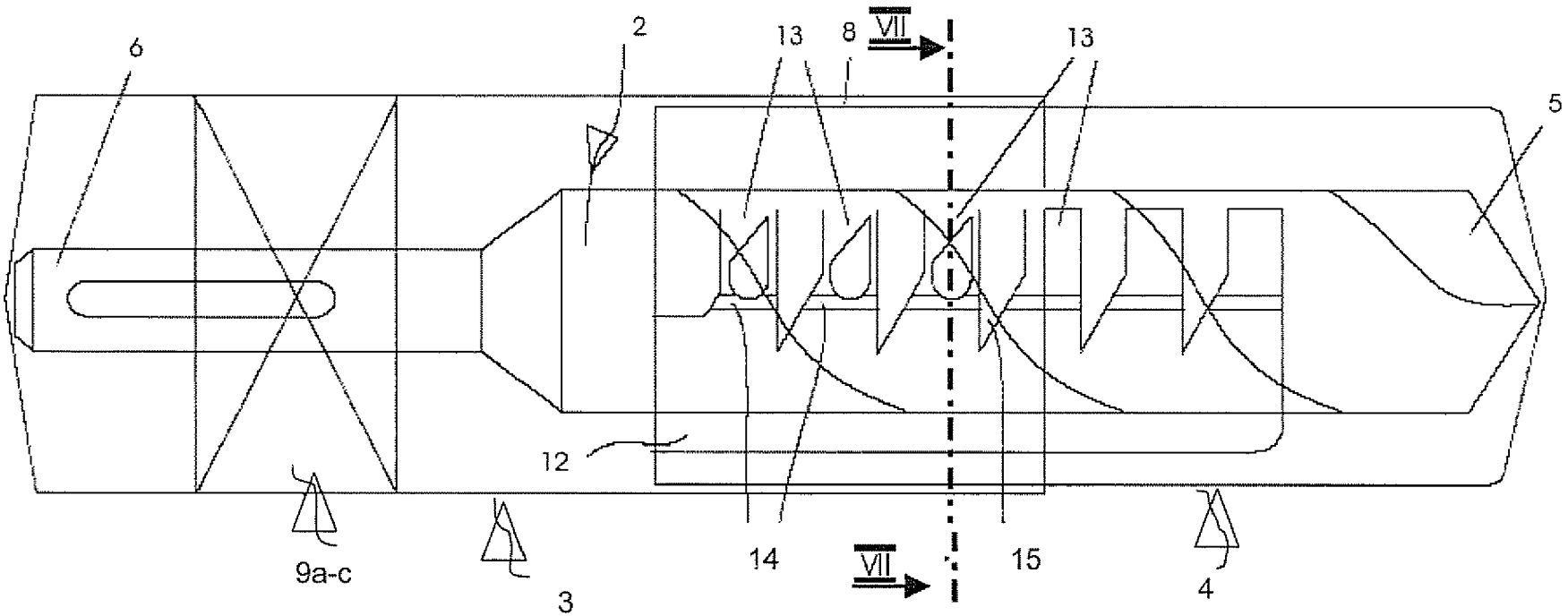
FIG. 4 is schematic of an example of an embodiment of the claimed packaging sleeve shown in combination with a bayonet closure.
Figure 6:
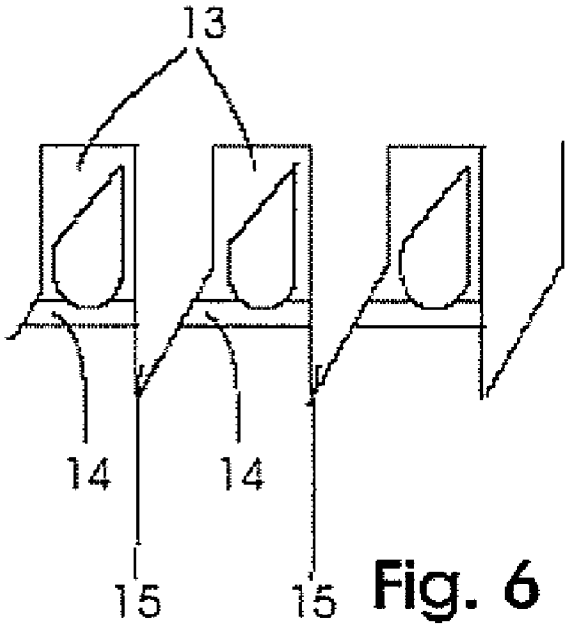
FIG. 6 is the bayonet closure according to FIG. 4, shown in the closed state.
Figure 5:
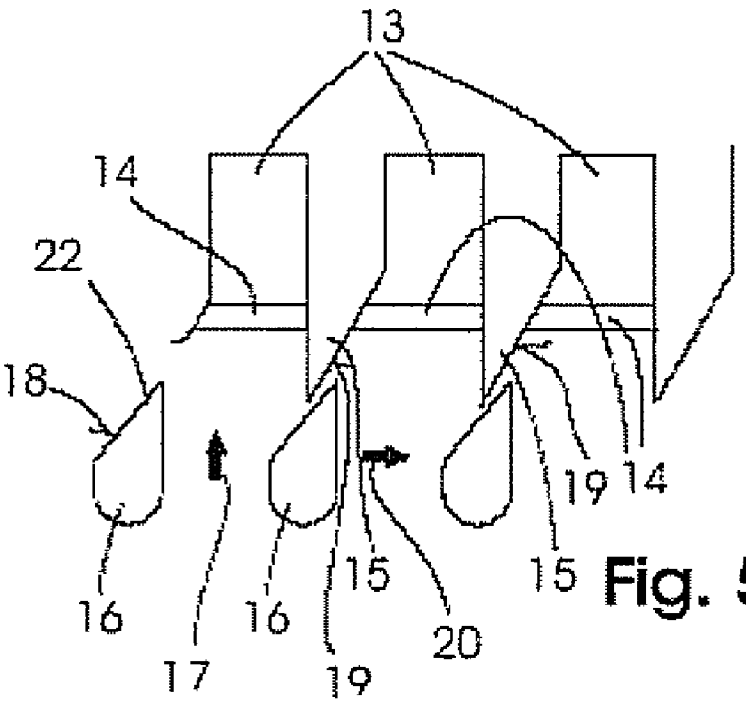
FIG. 5 is the bayonet closure according to FIG. 4, shown before entering the closed state.
Figure 7:
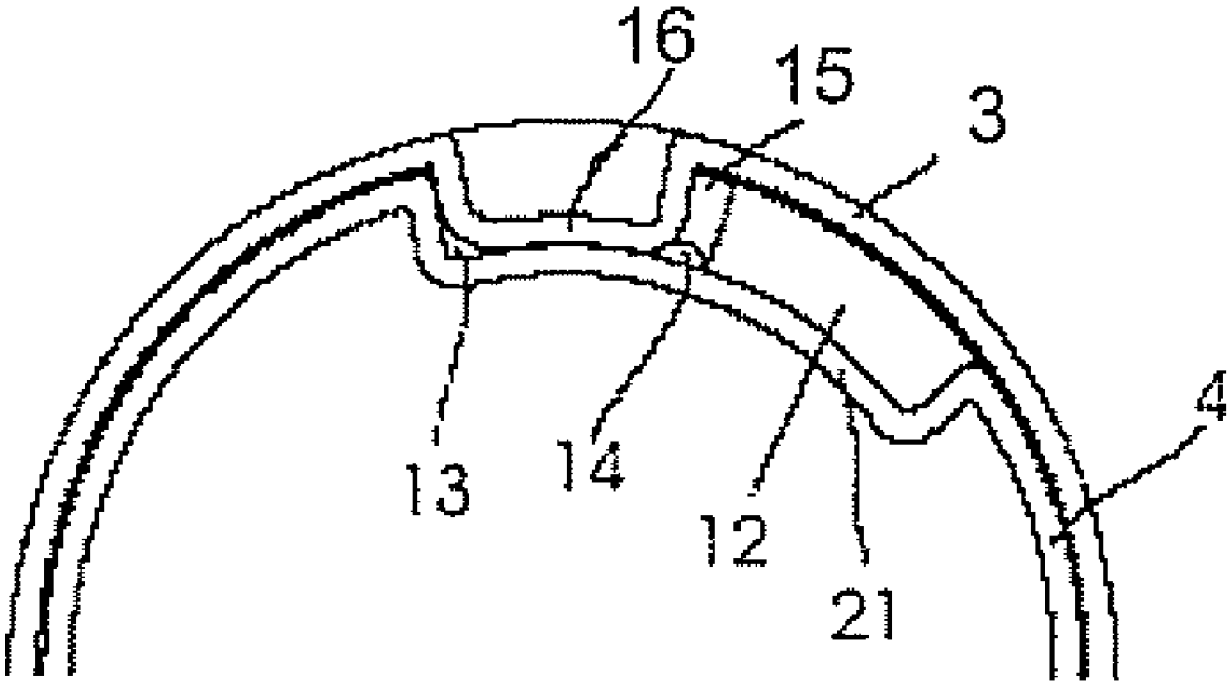
FIG. 7 is a cross sectional view of the claimed packaging sleeve shown in FIG. 4, cut through line 7-7.

In the example shown in FIG. 4, the internal part 4 is provided for fastening the point 5 of the drill bit 2, while the external part 3 is constructed for the purpose of fastening the shank 6 of the drill bit 2, The bayonet closure comprises a plug-in channel 12 oriented in axial direction in the area of the internal part 4 and formed by an indentation 21 in axial direction in the wall. In the radial direction, in the area of the indentation 21, a series of latch rib 14 protruding radially outward is provided and is oriented in the longitudinal direction (see FIG. 4). A series of opposite latch chambers 13 are disposed at a distance from one another within the internal part 4, wherein each latch chamber is closed by the above named latch rib 14 at the inlet end. The latch rib 14 rises above the bottom of the latch chamber, thus forming a surmountable hurdle. Each latch chamber 13 is equipped with a forward-oriented insertion tip 15 equipped with a bevel beveled in radial direction. In the external part, drop-shaped latch nubs 16 are disposed at a distance from one another and in alignment with the latch chambers 13, with the frontal tip 22 of the latch nubs each directed into a latch chamber 13 which is also equipped with a bevel 18 corresponding to the bevel 19 on the insertion tip 15. For achieving the closure, therefore, the latch nubs 16 are first disposed in axial direction offset to the latch chambers 13 (see FIG. 5); and during radial torsion between the internal and the external part, first a movement in anew direction 17 is performed. In this manner, the respective bevel 18 or latch nub 16 meets the bevel 19 of the insertion tip 15, thus causing an axial shifting motion in arrow direction 20. In this way, therefore, the external part 3 is prestressed against the internal part 4 and the radial movement continues until the drop-shaped latch nubs 16 have surmounted the latch ribs 14 in the latch chamber 13 and rest there in latched position. Thus, they are protected from arbitrary opening. Thereby, an opening force acting (shown as by arrow directions 10, 11 in FIGS. 1-3) on the bayonet closure in opening direction according to FIGS. 4 through 7 is exerted without the bayonet closure being released. At the same time, this latching motion causes the elastic tension structure in the form of bellows or a corrugated bellows 9-9*c* to be stressed, and the shank 6 and the point 5 of the drill bit 2 are fixed to the interior wall 3*a*, 3*b* of the parts 3, 4 of the packaging sleeve 1. In order to close the entire packaging sleeve, the drill bit 2 is placed into the open packaging and the external part 3 is pushed onto the internal part 4. In this position, the latch closure is not yet closed or latched, and the shank 6 and the point 5 respectively already rest against the interior walls 3*a*, 3*b* of the parts 3, 4. Next, the internal part 4 is radially twisted in relation to the external part 3, in order to cause the bayonet closure to latch. This generates the motion in arrow direction 20 shown in to FIG. 5, and the parts 3, 4 of the packaging sleeve are prestressed against one another, which causes the elastic tension structure 9-9*c* to be prestressed also, therefore exerting a constant prestress force on the drill bit 2 stored in the packaging sleeve.

Thus, two examples of embodiments of the closure are described:

1 In a first example, the drill bit is fixed in place by bringing the closure into its arrested closed position in order to operate the closure by the fraction of an additional rotation, in order to stress the elastic tension structure so that the drill bit is fixed in place in a force-closed and positive fashion. An example of a closure of this type is self-retaining threading.

2. In a second example, the closure is not arrested until a rotation is performed and the elastic tension structure is simultaneously prestressed. An example of a closure of this type is a bayonet closure.

| Legend for the drawings | |
|---|---|
| 1 | packaging sleeve |
| 2 | drill bit |
| 3 | external part |
| 4 | internal part |
| 5 | point |
| 6 | shank |
| 7 | arrow direction |
| 8 | closure |
| 9 | elastic tension structure 9a-9c |
| 10 | arrow direction |
| 11 | arrow direction |
| 12 | plug-in channel |
| 13 | latch chamber |
| 14 | latch rib |
| 15 | insertion tip |
| 16 | latch nub |
| 17 | arrow direction |
| 18 | bevel (latch nub 16) |
| 19 | bevel |
| 20 | arrow direction |
| 21 | indentation |
| 22 | tip |
| 3a | interior wall of external part |
| 4a | interior wall of internal part |

I claim:

1. A zero-clearance packaging for elongate objects, said packaging comprising a packaging sleeve having:

an internal part having an interior wall;

an external part that receives said internal part in the direction of a longitudinal axis, said external part also having an interior wall;

a closure that is disposed between said internal part and said external part, said closure being capable of pushing said internal part and said external part together in a telescopic fashion in the direction of the longitudinal axis with the internal part being received in the external part and holding said internal part and said external part in a closed position; and at least one elastic tension structure that is disposed over an axial length of said external part, over an axial length of said internal part, or over an axial length of both, wherein said at least one elastic tension structure has a length that is variable in the direction of the longitudinal axis such that the elastic tension structure elongates in the direction of the longitudinal axis at times when said closure urges said internal part and said external part together in a telescopic fashion while the interior wall of said internal part contacts one end of said elongate object and the interior wall of said exterior part contacts another end of said elongate object such that the interior walls of said internal part and said external part are placed in tension across said elongate object wherein said elastic tension structure comprises a wall of said internal part, a wall of said external part, or a wall of said internal part and said external part, said wall being constructed as bellows over at least a particular axial length.

2. A packaging sleeve according to claim 1, wherein a wall construction of said external part and/or said internal part of said packaging sleeve is constructed as said elastic tension structure that elongates in the direction of longitudinal extension of said packaging sleeve.

3. A packaging sleeve according to claim 2 wherein said closure is self-retaining and/or a latch type.

4. A packaging sleeve according to claim 3, wherein said closure is a self-retaining threaded screw closure.

5. A packaging sleeve according to claim 3, wherein said closure is a latching bayonet closure.

6. A packaging sleeve according to claim 5, wherein said bayonet closure achieves a closure of said packaging by facilitating a retention-free and resistance-free torsion between said external part and said internal part, and wherein opposed parts of said bayonet closure comprise bevels on one of said parts that meet corresponding insertion bevels on the other of said parts.

* * * * *